United States Patent [19]

Uhlmann et al.

[11] 4,096,726

[45] Jun. 27, 1978

[54] METHOD AND APPARATUS FOR DRAWING TUBES

[75] Inventors: Otto Uhlmann, Burgdorf; Norbert Stephan, Hanover, both of Germany

[73] Assignee: Marshall Richards Barcro Limited, Crook, England

[21] Appl. No.: 767,795

[22] Filed: Feb. 11, 1977

[51] Int. Cl.[2] ..... B21C 1/34

[52] U.S. Cl. ..... 72/291

[58] Field of Search ..... 72/284, 283, 287, 291

[56] References Cited

U.S. PATENT DOCUMENTS

| | | | |
|---|---|---|---|
| 2,597,500 | 5/1952 | Kerr | 72/283 |
| 3,765,215 | 10/1973 | Martin | 72/283 |

FOREIGN PATENT DOCUMENTS

| | | | |
|---|---|---|---|
| 122,657 | 12/1944 | Australia | 72/284 |
| 542,193 | 3/1956 | Germany | 72/283 |

*Primary Examiner*—Michael J. Keenan

*Attorney, Agent, or Firm*—Prutzman, Hayes, Kalb & Chilton

[57] ABSTRACT

The invention relates to an improved method and apparatus for tube drawing which relates to the use of a floating plug and die arrangement, the necessary draughting tension in the tube being drawn being generated by a rotatable tube block around which the tubing downstream of the die is wrapped. The invention proposes to mount a tube guide upstream of the die in such wise that the relative spacing between the guide and the die can be a minimum during threading-up of the die but increased during drawing.

6 Claims, 2 Drawing Figures

METHOD AND APPARATUS FOR DRAWING TUBES

Figure 1:
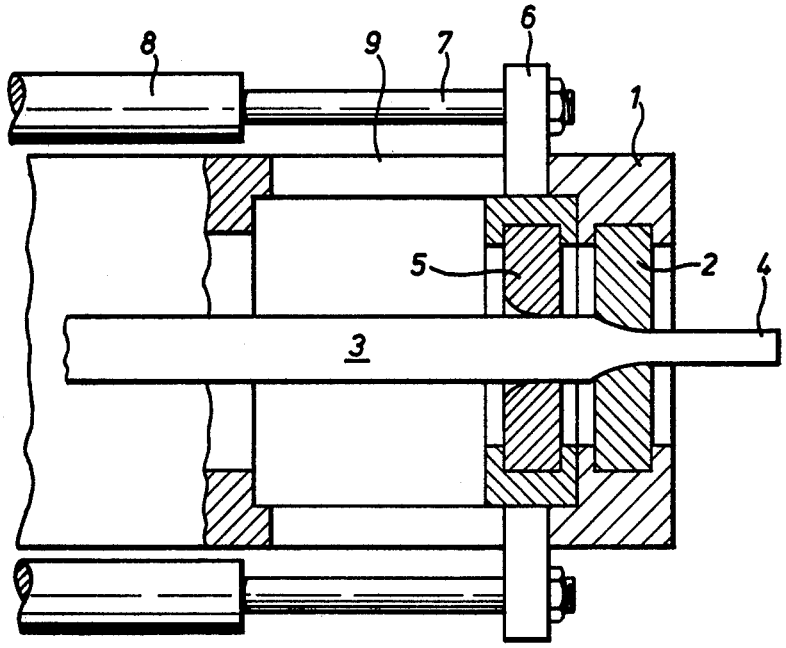

This invention relates to a method and apparatus for drawing tubes, e.g. of copper, which tubes may be in the form of an annular coil, wherein the tube runs through a drawing die and on to a drawing block providing the necessary draughting tension.

In the drawing of metal tubes using rotatable drawing blocks, it is very important that the tube, particularly if it is in the form of an annular coil, should be accurately guided into the die, if irregular wall thicknesses are to be avoided. Accurate guiding of the tube into the die can be ensured with the use of a guide means upstream of the die however, the distance between the guide means and the drawing die must not be less than a certain value, and the inside diameter of the guide means must correspond approximately to the outside diameter of the tube being drawn in that die.

The greater the distance between the drawing die and the guide means, however, the longer must be the pointed end provided on the tube for the threading-up operation (it is this pointed end which is secured to the block but it is not itself marketable as drawn tubing).

Thus the longer the pointed end the greater the tube wastage, and consequently it has become the usual practice to locate the guide means closer to the die than desirable and to make the inside diameter of the guide means slightly greater than the outside diameter of the tube being drawn, even though accurate guiding is then no longer achieved.

It is an object of the present invention to provide a method and an apparatus which not only make it possible to shorten the above-mentioned pointed end portion but which also make possible substantially improved guiding and consequently improved quality of the drawn tube, in comparison with the prior-art techniques.

According to the present invention, there is provided a method of drawing a tube wherein the tube runs through a drawing die and on to a drawing block providing the necessary draughting tension, in which method the portion of the tube upstream of the drawing die is passed through a guide means having an axis substantially collinear with the axis of the drawing die, the tube guide means being disposed immediately upstream of the drawing die during threading-up of the die, but the distance between the tube guide means and the drawing die being increased upon drawing being commenced. Until the actual commencement of drawing, therefore, the drawing die and tube guide means are at a minimum distance from one another, so that the length of the above-mentioned pointed end portion can also be kept to a minimum. (This short leading end portion is referred to below as a "spike"). Upon drawing being commenced, however, the guide means is moved away from the drawing die, or the drawing die is moved away from the guide means, to optimise the guiding effect of the guide means.

It has been found preferable to move the tube guide means hydraulically with respect to the die.

The invention also includes an apparatus for carrying out the method defined above, which apparatus comprises, in addition to means for exerting a draughting tension to the tube, and means for the supply of undrawn tube, an assembly comprising a stationary die holder in which a drawing die is accommodated in a fixed position and comprising also a tube guide means which is displaceable along the axis of the tube passing though the die.

The tube guide means is preferably mounted on rams which can be advanced or retracted along the said axis by means of respective hydraulic cylinders.

Figure 2:
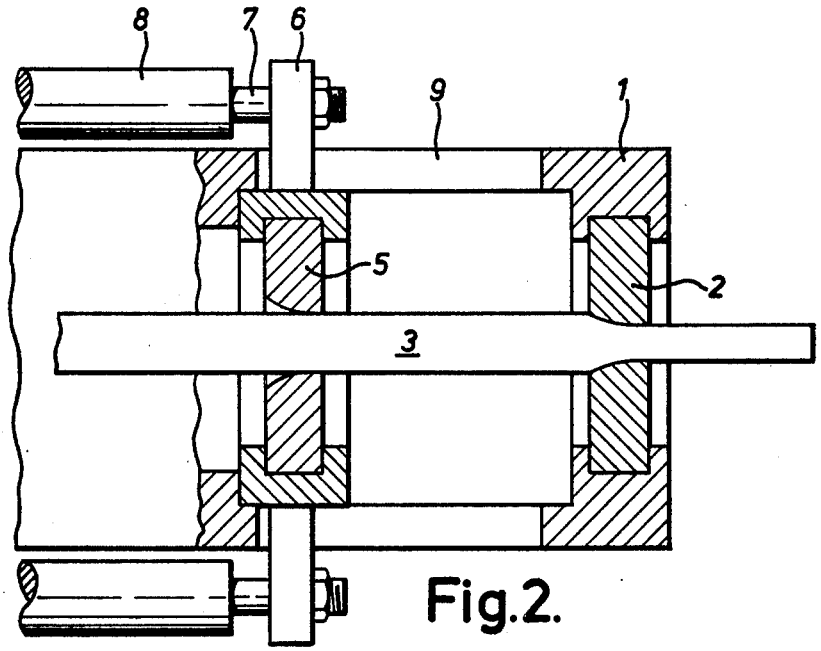

The invention will now be explained more fully, by way of example, with reference to the accompanying diagrammatic drawing, in which:

FIG. 1 is a side view, mainly in section, of an apparatus employed in accordance with the invention and shows the position of a guide means just before the commencement of a drawing operation, and FIG. 2 is a view similar to FIG. 1 but showing the position of the guide means just after the commencement of drawing.

FIGS. 1 and 2 show a tube-drawing die 2 mounted as a stationary component in a die holder 1. For the purpose of drawing-down a tube 3, which may for example be a copper tube, a floating plug (not shown) is inserted into the bore of the tube 3 at its leading end. A spike 4 is then formed at the leading end of the tube 3 by a conventional pointing operation, and this spike, after it has been passed through the opening of the die 2, is securely engaged in a gripping means (e.g. a pulling-in dog) provided on a drawing block (also not shown). In order that the tube 3, even if it is in the form of a coil, may be guided accurately to the die 2, a guide means 5 is provided, which is mounted slidably in the die holder 1. The apertures provided in the die 2 and the means guide 5 for the passage of the tube 3 are coaxial, though they are spaced apart in the axial direction. The guide means 5 is mounted in a carrier 6 whose radially outermost portions are fastened to the ends of rams 7 which can be advanced or retracted by means of respective hydraulic cylinders 8. In the die holder 1 there are provided slots 9 along which the carrier 6 of the guide means 5 can move.

Before the commencement of drawing (see FIG. 1), the guide means 5 and the carrier 6 are brought as close as possible to the die 2, and the spike 4 of the tube 3 is passed through the die and gripped by the gripping means of the drawing block. The drawing operation can then start. Concurrently with the commencement of drawing, the guide means 5 and the carrier 6 are moved in the opposite direction to the direction of advance of the tube 3, until they reach the position shown in FIG. 2. The distance between the die 2 and the guide means 5 should be sufficient to ensure that, after drawing has been completed and the above-mentioned plug has passed out of the tube 3, this plug can be removed from the holder 1.

The distance between the guide means 5 and the die 2 can also be increased by movement of the die. Thus the arrangement can be such that the die 2 is carried along by the tube 3 as it is advanced, until a predetermined limiting position of the die 2 is reached; then when the drawing of the tube 3 is completed the die 2 is returned by spring force to its starting position.

It is a particular advantage of the method of the present invention that, although the length of the spike 4 can be reduced to a minimum, optimum guiding of the tube 3 can still be achieved. Furthermore it is possible to dispense with the straightening devices hitherto employed for producing a long straight length of tube to facilitate threading-up. Assuming that the tube is in the form of an annular coil, the length of the drawing tangent, that is to say the distance between the point at which the tube runs off the annular coil and the point at which it runs on to the drawing block, can be reduced to a minimum. Consequently the space required for the drawing equipment as a whole can be made smaller.

We claim:

1. In a tube drawing method having at least one drawing step at a drawing stage with a drawing die, a tube guide upstream of the die for receiving and guiding the tube coaxially to the die and a downstream rotatable draw block for drawing the tube through the die, comprising the steps of axially threading the tube through the guide and die with the tube guide a first distance immediately upstream of the die to reduce the required length of tube for threading the tube through the guide and die, and drawing the tube through the guide and die with the draw block with the coaxial tube guide upstream of the die a second distance substantially greater than said first distance providing for accurately guiding the tube coaxially to the die.

2. A tube drawing method according to claim 1 wherein the method comprises drawing the tube through the coaxial guide and die from an annular coil thereof.

3. A tube drawing method according to claim 1 wherein the tube is a copper tube.

4. A tube drawing method according to claim 1 wherein the method comprises axially shifting the guide upstream from the die to said second increased distance from the die at the commencement of drawing the tube through the die with the draw block.

5. A tube drawing method according to claim 4 wherein the tube guide shifting step comprises hydraulically axially shifting the tube guide upstream from the die.

6. In a tube drawing system having at least one drawing stage comprising a drawing die, a tube guide upstream of the die for receiving and guiding the tube coaxially to the die, and a downstream rotatable draw block operable for drawing the tube through the die, the improvement wherein the drawing stage further comprises tube guide mounting and shifting means for mounting the tube guide coaxially with the die and for hydraulically axially shifting the tube guide between a first position immediately upstream of the die for threading the tube through the guide and die and a second position substantially upstream of the die for accurately guiding the tube coaxially to the die as the tube is drawn therethrough by the draw block.

* * * * *